United States Patent [19]

Guenther et al.

[11] Patent Number: 4,494,742

[45] Date of Patent: Jan. 22, 1985

[54] INSERTER WITH IMPROVED MEDIA TRANSPORT HAVING PIVOTAL SPRING BIASED SHEET HOLD-DOWNS ADJACENT TRANSPORT BELT

[75] Inventors: Kenneth L. Guenther, Park Ridge; Edward H. Zemke, Chicago, both of Ill.

[73] Assignee: Bell & Howell Company, Chicago, Ill.

[21] Appl. No.: 415,494

[22] Filed: Sep. 7, 1982

[51] Int. Cl.[3] ..... B65H 39/02

[52] U.S. Cl. ..... 270/58; 198/836; 198/733

[58] Field of Search ..... 270/58; 198/836, 733, 198/730, 729, 725; 271/2

[56] References Cited

U.S. PATENT DOCUMENTS

| | | | |
|---|---|---|---|
| 3,010,565 | 11/1961 | Pasinski | 198/725 X |
| 3,180,479 | 4/1965 | Meeks et al. | 198/733 |
| 3,589,502 | 6/1971 | Maillet et al. | 198/729 |
| 4,163,491 | 8/1979 | Rock et al. | 198/836 |
| 4,163,550 | 8/1979 | Armstrong | 198/836 X |

*Primary Examiner*—E. H. Eickholt

*Attorney, Agent, or Firm*—Neal C. Johnson; Alan H. Haggard; Alan B. Samlan

[57] ABSTRACT

An inserting machine having an improved hold-down member which provides for reduced friction between the hold-down member and the inserts as the inserts pass beneath the hold-down member. An endless belt moves with the lugs in order to transport the inserts along the insert track while friction between the bottom-most insert in a stack and the insert track. The possibility of thin or flimsy inserts jamming the insert track or being erroneously moved to another insert pile is greatly reduced.

19 Claims, 5 Drawing Figures

INSERTER WITH IMPROVED MEDIA TRANSPORT HAVING PIVOTAL SPRING BIASED SHEET HOLD-DOWNS ADJACENT TRANSPORT BELT

BACKGROUND OF THE INVENTION

This invention relates to machines for inserting mail pieces into envelopes and is directed more particularly to improvements in transporting the inserts or mail pieces along the insert track or raceway.

Business machines of the class commonly referred to as inserters are also referred to as envelope handling or stuffing machines. They are generally constructed and arranged for relatively high speed cycling for the gathering, collating, and inserting of mail pieces into envelopes. Examples of such equipment are illustrated in detail in the U.S. Pat. No. 2,325,455 to Williams which relates to a multi-station inserter. Another such example is illustrated in U.S. Pat. No. 3,306,606 to Sather et al which is directed to a multi-station inserter having an insert track or raceway which can reverse its direction of movement.

Such inserters have one or more insert stations with a stack of inserts at each station. Mechanical grippers withdraw the bottom insert from each stack of inserts and drop them onto a stationary insert track in front of a pair of pins or lugs on a driven chain. The chain is intermittently moved past the several insert stations and is momentarily stopped in front of each station as a new insert is dropped onto the track. As the lugs move past the insert stations, the inserts are collected in a pile which is then stuffed or inserted into an envelope.

As the number or thickness of the inserts increase, there is the possibility of inserts in one pile on the track overflowing or inadvertently falling into the succeeding pile on the track. An effort to alleviate this problem has been to provide adjustable hold-down members which can push down the inserts after they are withdrawn and deposited onto the insert track. These hold-down members are adjusted to a fixed height above the track to hold the pile down at a certain thickness as the pusher fingers move the pile of inserts towards the next insert or stuffer station. In some inserters, however, the number of inserts deposited onto each pile of inserts on the track may vary. Since the height of successive piles of inserts varies, the use of hold-down members which are adjusted to a fixed height above the stack has been found to be unsatisfactory.

In addition, there has been some difficulty in keeping thin, tissue-type inserts in their own insert piles as the number of inserts in a given pile increases. This is due to the flimsiness and lack of body of the thin insert. More specifically, the hold-down member compresses the pile of inserts resulting in substantial friction between the hold-down member and the top insert in the pile of inserts. Additionally, due to the compressive force of the hold-down member, there is substantial friction between the bottom most insert in the pile and the stationary insert track. This friction must be overcome by the lugs as they attempt to push the pile along the insert track past all of the insert stations and into the stuffing or insertion station. It has been found that as the number of inserts increases, and if there are one or more thin or flimsy inserts, these thin inserts have a tendency to not overcome the start up friction of the thin insert against the hold-down member. This is aggravated by the fact that the thin insert lacks the body strength to resist buckling or folding. As the lugs push the pile of the inserts along the track to the next insert station, the top, thin insert, tends to stick to the hold-down member or to buckle. This results in either a machine jam of the inserts or the insert is erroneously moved into the next pile of inserts. Should the misdirected insert be personal or confidential, the results could be disastrous.

Similar problems result from a thin insert being at the bottom of the pile of inserts. Here, the insert rests on the insert track and must overcome the friction between its bottom surface and the stationary insert track each time the pile moves. Thus, if the friction is not overcome, the insert, due to its flimsiness, buckles. Again this results in machine jams or misdirected, misplaced or lost document inserts. Thus, it is an object of the present invention to provide an improved inserting machine which has means to maintain thin or flimsy inserts in the pile of inserts in which they are deposited.

It is another object to provide an improved inserter in which there is provided an improved inserter hold-down member which reduces friction between the uppermost insert in the pile of inserts and the hold-down member while the inserts are moved along the insert track.

Yet another object is to provide an improved inserter which reduces the friction between the bottom-most insert of a pile of inserts and the insert track.

SUMMARY OF THE INVENTION

The present invention reduces the friction between the insert and the components of the inserter which contact and rub against the inserts thereby solving the problem of having thin or flimsy inserts buckling and jamming the inserter or inadvertently slipping from one pile of inserts to another pile of inserts. More particularly, the inserts move along the insert track by means of lugs mounted on a driven chain. Hold-down members compress the pile of inserts as they are moved along the insert track. Each hold-down member includes rollers which contact the top insert. This allows the insert to freely move under the hold-down member as compared to the normal amount of friction between the hold-down member and the insert. The insert track includes an endless belt along the surface of the track with the bottom-most insert in a pile at least partially resting on the endless belt. The belt moves along with the lugs thereby aiding in the movement of the insert pile. The friction between the bottom-most insert and the insert track is substantially reduced.

BRIEF DESCRIPTION OF THE DRAWINGS

Other objects, features and advantages of the present invention will be readily apparent from the following detailed description of the preferred embodiment taken in conjunction with the accompanying drawings in which.

DESCRIPTION OF THE PREFERRED EMBODIMENT

Figure 1:
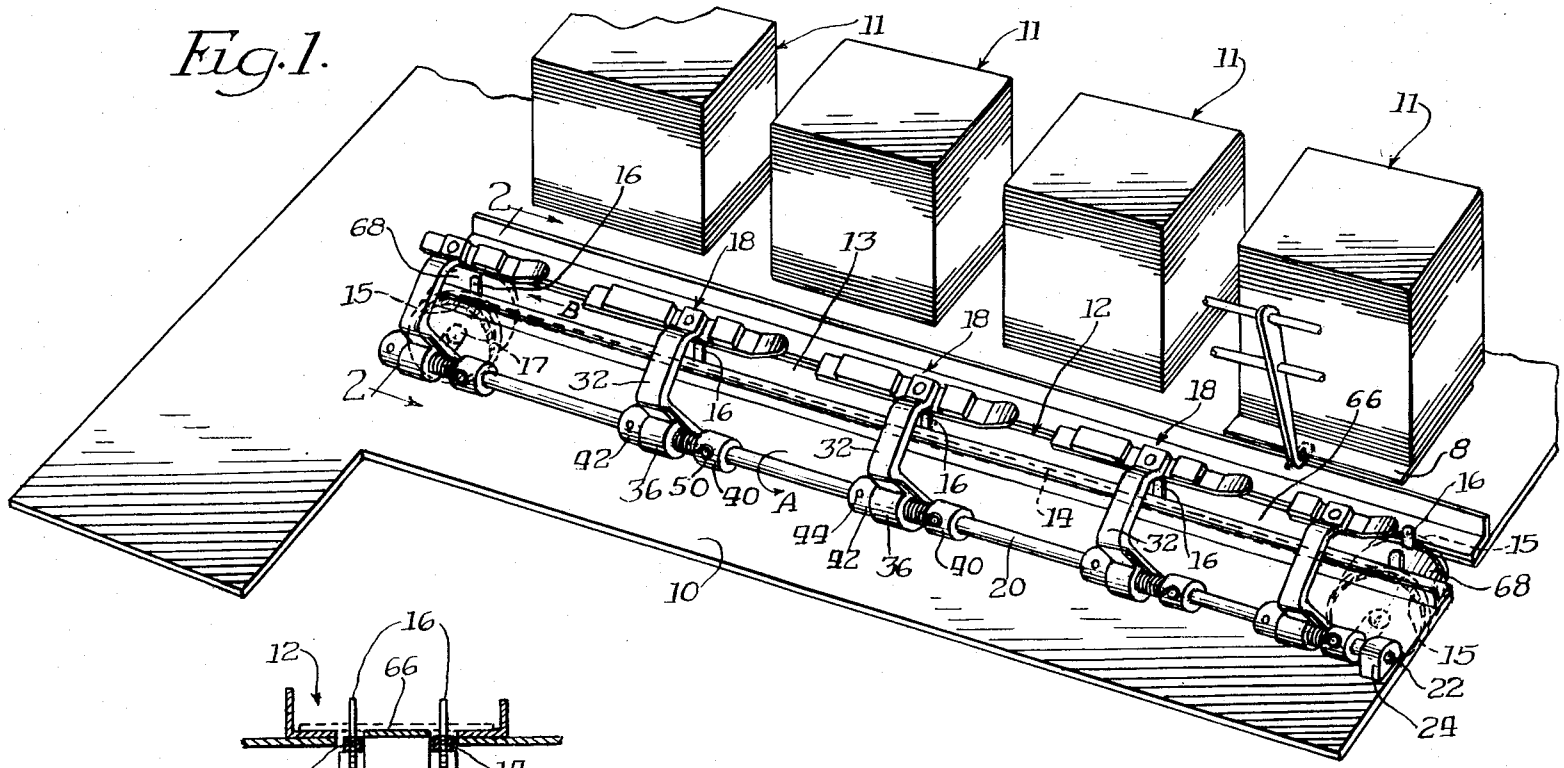
FIG. 1 is a perspective view with portions removed of a portion of the insert track of an inserter illustrating a preferred embodiment of the invention.

Turning first to FIG. 1 there is shown a portion of an inserter of the type known in the prior art. The inserter includes a horizontal table 10, a series of adjacent insert stations 11 and an insert track 12. Individual inserts are withdrawn from the stacks of inserts at stations 11 and moved successively to an envelope inserting station (not shown) where the inserts are placed into receiving envelopes. The bottom insert of each stack is withdrawn from the stack by a gripper jaw and is deposited onto an insert track 12 at each insert station. One example of a suitable insert station having a gripper jaw is shown in U.S. Pat. No. 3,260,517 issued to C. Sather entitled "Predetermined Feed Selection for Multi Station Inserters".

Figure 2:
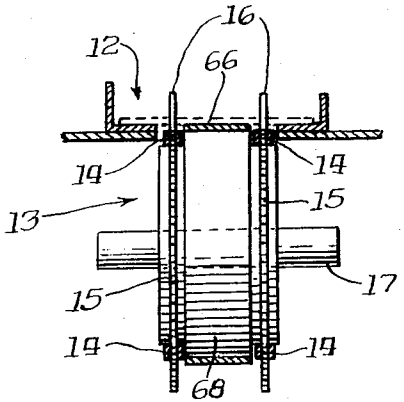
FIG. 2 is an end view in cross section taken along line 2—2 of FIG. 1.
Figure 3:
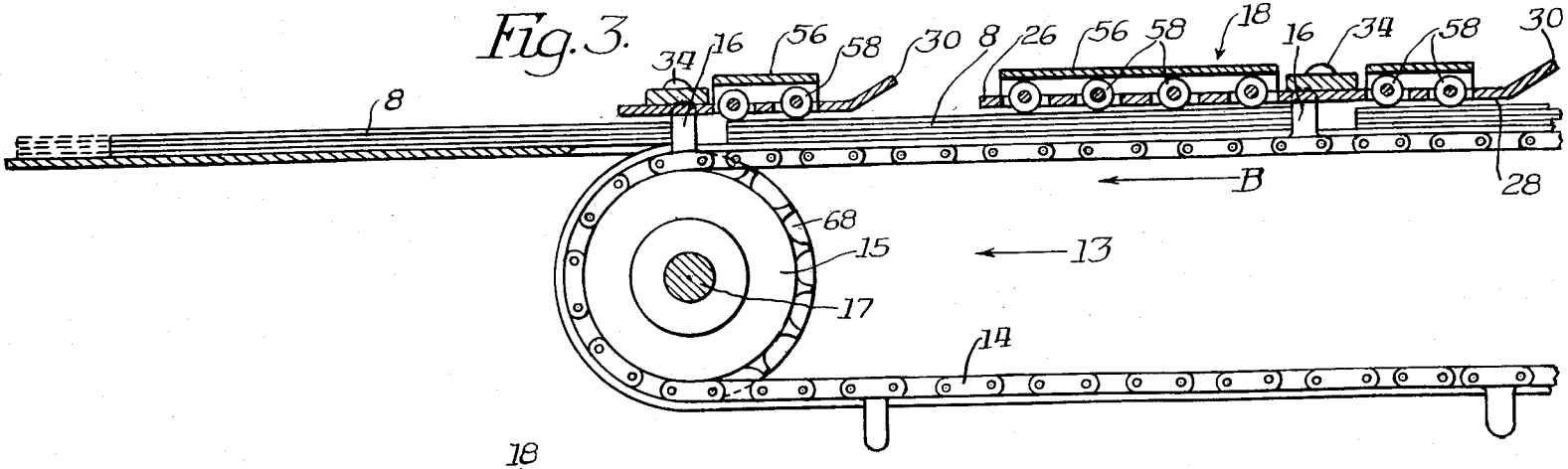
FIG. 3 is a cross sectional view with portions removed of inserts being moved along the insert track illustrating the hold-down member.

As shown in FIGS. 1–3, the insert track 12 includes an endless conveyor 13 and a pair of parallel chains 14 disposed about two pairs of coaxial sprockets 15 mounted respectively at opposite ends of the track 12. Mounted on each of the chains 14 are spaced pairs of lugs 16 which engage the ends of the inserts 8 when disposed on the conveyor 13. The conveyor is driven from a drive shaft 17 so that the inserts on the conveyor as delivered from the various stacks are moved successively toward the envelope inserting station.

At each insert station a hold-down member 18 pushes or compresses the inserts on the conveyor after the inserts are deposited on the conveyor 13. The hold-down member 18 continues to keep pressure on the inserts as the drive chains 14 move the lugs 16 forward to the next insert station. As will be more fully described below, each hold-down member 18 is pivoted in a raising and lowering motion by means of a rocker shaft 20 which has one end mounted in a bearing 22 which is retained within a bearing support 24. The opposite end of the rocker shaft 20 is also retained within bearing means (not illustrated). Rotational movement of the rocker shaft 20 is controlled by suitable drive means such as a crank arm arrangement to raise and lower the members 18.

An insert 8 is retrieved from a stack and dropped onto the insert track 12 when the hold-down member 18 is in the raised position in response to rotation of the shaft 20 in the direction of arrow A (FIG. 1). The hold-down member 18 is lowered in response to rotation of shaft 20 in the opposite direction. The hold-down member 18 stays down until the next insert is ready to be deposited onto the insert pile in the track 12.

In the past, when thin or flimsy inserts are deposited on the conveyor between the pairs of lugs 16 and the hold-down member 18 applies its compressive force to the pile of inserts, there is the possibility of one of the thin inserts sticking to or buckling under the hold-down member 18 and being re-deposited on an adjacent pile of inserts between adjacent pairs of lugs. This would place the insert in the wrong insert pile.

Figure 4:
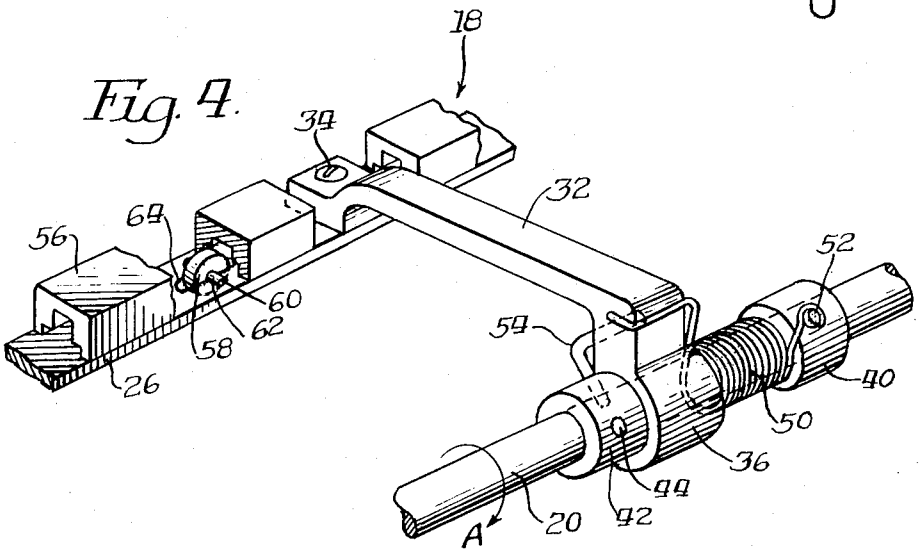
FIG. 4 is an enlarged view of one hold-down member, with portions removed.

Turning now to FIGS. 3 and 4, it can be seen that the drive chains 14 move in the direction of the arrow B due to the counter-clockwise rotation of sprocket 15. Thus, the inserts 8 will be pushed to the left as illustrated in FIGS. 3 and 4. The hold-down member 18 comprises a shoe 26 having a bottom-most smooth surface 28 and an upwardly inclined toe 30 which aids in guiding the inserts to pass underneath the shoe 26. The construction of the hold-down member 18 is discussed below.

The shoe 26 is connected to one end of a rocker arm 32 by means of a screw or fastener 34. The other end of the rocker arm 32 includes an integral sleeve 36 through which is received the rocker shaft 20. A pair of locking sleeves 40 and 42 are affixed to the rocker shaft 20 by means of respective set screws 44. A coil spring 50 is mounted on the shaft 20 between the sleeve 36 and the locking sleeve 40, with one end of the spring engaging a pin 52 secured to the sleeve 40 and the other end engaging the arm 32. The spring 50 applies a force against the rocker arm 32 which tends to force the rocker arm 32 down, compressing the inserts in the insert track 12. An L-shaped pin 54 is secured to the locking sleeve 42 and disposed to engage the underside of the arm 32 when the rocker shaft 20 is rotated in the direction of arrow A to thus raise the hold-down member 18. The inserts are deposited on the track 12 when the rocker arm 32 is in this raised position. Thus, by synchronizing the rotation of the rocker shaft 20 with the movement of the lugs 16, the position of the hold-down member 18 can be controlled relative to the location of the insert pile.

As previously mentioned, the spring 50 tends to force the hold-down member 18 against the inserts 8 on the track 12. If there is a jam or for some reason it is necessary to raise the hold-down member 18 to have access to the inserts, this is easily accomplished. The operator must only pull up on the shoe 26 or rocker arm 32 and overcome the force of spring 50. Each hold-down member 18 can be raised in this manner independently of the others. The amount of travel of the shoe 26 down towards the insert track 12 can also be controlled by controlling the location of the L-shaped pin 54 by rotating and locking the sleeve 42.

Referring now to FIGS. 3 and 4, a block 56 on the top surface of the shoe 26 houses a plurality of rollers 58 mounted on respective shafts 60. Each shaft 60 rests in a groove 62 cut into the top surface of the shoe 26. An opening 64 is defined through the shoe 26 enabling the respective roller to extend below the bottom surface 28.

In operation, as the hold-down member 18 is lowered to compress the insert pile and as the insert passes beneath the shoe 26, the bottom smooth surface 28 no longer contacts and rubs against the top insert 12 in an insert pile. Rather, the rollers 58 roll over the top insert as the insert pile moves beneath the hold-down member 18. The rollers 58 have a lower coefficient of friction than the inserts had against the bottom smooth surface 28. This permits thin or flimsy documents to easily pass beneath hold-down member 18 without buckling or sticking to the bottom surface 28.

As best shown in FIG. 1, an endless belt 66 is trained about a pair of pulleys 68 mounted coaxially between the pairs of sprockets 15 at opposite ends of the track 12. The upper surface of the belt 66 is thus disposed longitudinally of the track between the lugs 16. The belt 66 is driven from the input shaft 17 and moves in conjunction with the lugs to assist the movement of the inserts along the track. Thus, the lugs 16 do not have to overcome the entire friction of the bottom-most insert being compressed on the insert track as was conventional in prior art devices. Rather, the belt 66 moves along with the lugs and only the friction of a portion of the inserts rubbing against the insert track must be overcome.

The belt 66 drops beneath the top surface of the insert table 10 before the lugs 16 lose contact and control of pushing the insert pile forward into the final insertion or stuffing station. This is desirable since the lugs 16 maintain positive control over the inserts by pushing them forward into the insertion station as compared to the belt 66 which can slide with respect to the bottom-most insert. By maintaining accurate control of the inserts as they are pushed into the final insertion station, the registration of the inserts and the alignment of their edges can be maintained such that they are properly aligned and inserted into the envelope as a single stack.

Figure 5:
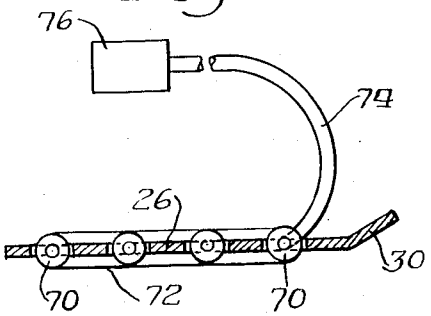
FIG. 5 is a schematic illustration of an alternate embodiment hold-down member in which the rollers in the hold-down member are driven.

FIG. 5 illustrates an alternate embodiment of the hold-down member 18. The shoe 26 has several rollers 70 mounted in a similar manner as is illustrated in FIG. 4. However, around the outside circumference of the rollers 70 is placed an endless belt 72. One of the rollers 70 is connected by flexible coupling means 74 to a suitable drive shaft or drive means 76 which is connected and synchronized with the movement of the lugs 16. Thus, as the lugs 16 move the inserts beneath an insert station, the drive shaft 76 causes the belt 72 to be moved in the same direction and approximately at the same peripheral speed as the inserts are moved beneath the shoe 26. This further reduces any friction between the belt 72 and the top most insert 11 in an individual stack.

Thus, there has been provided an inserter that fully satisfies the objects, aims and advantages set forth above. It is evident that many alternatives, modifications, and variations will be apparent to those skilled in the art. Accordingly, it is intended to embrace all such variations as fall within the spirit and broad scope of the appended claims.

What is claimed is:

1. In an inserting device adapted to feed individual inserts from stacks thereof to a station wherein the inserts are inserted within envelopes, an improved insert transport means compromising:

an insert track on which the inserts are deposited after being withdrawn from the insert stack;

chain drive means with lugs mounted thereon on the insert track for moving the inserts along the insert track towards the envelope inserting station;

insert hold-down members which pivot out of the way of the inserts as the inserts are withdrawn and deposited onto the insert track and which pivot to a position above and on top of the inserts to apply a compressive force to the inserts after the inserts have been withdrawn and deposited onto the insert track; and belt means on the insert track to transport the inserts towards the insertion station and means to move the belt means towards the insertion station in cooperation with movement of the chain drive means for moving the inserts along the track, with the belt means supporting at least a portion of the insert to reduce the friction between the inserts and the insert track as the inserts are moved along the insert track towards the envelope insertion station.

2. The inserting device of claim 1 wherein the belt means comprises an endless belt of which a portion rests on the insert track and the balance is below the insert track.

3. The inserting device of claim 2 wherein the means to move the belt means comprises at least two pulleys with the belt supported thereon, and drive means connected to at least one of the pulleys to rotate the pulley thereby moving the belt means.

4. The inserting device of claim 3 wherein the chain drive means for moving the inserts along the track has the chain supported by at least two sprocket gears and the drive means is connected to at least one of the sprocket gears to rotate the sprocket gears thereby moving the chain.

5. The inserting device of claim 4 wherein at least one of the sprocket gears and one of the pulleys are mounted on a common shaft before the insertion station in the direction of insert movement, with the radius of the pulley smaller than the distance from the center of the sprocket gear to the top of the lugs so that the lugs alone continue to push the inserts towards and into the insertion station after the belt has dropped below the insert track due to its following the pulley circumference.

6. The inserting device of claim 5 wherein each sprocket gear and pulley comprise a set, with each set mounted on a common shaft to rotate together, and the lugs and belt move in unison.

7. In an inserting device adapted to feed individual inserts from stacks thereof to a station wherein the inserts are inserted within envelopes, an improved insert transport means compromising:

an insert track on which the inserts are deposited after being withdrawn from the insert stack;

chain drive means with lugs mounted thereon on the insert track for moving the inserts along the insert track towards the envelope inserting station;

insert hold-down members which pivot out of the way of the inserts as the inserts are withdrawn and deposited onto the insert track and which pivot to a position above and on top of the inserts to apply a compressive force to the inserts after the inserts have been withdrawn and deposited onto the insert track; and roller means mounted on a face of the insert hold-down member which contacts the top insert on the track when the hold-down member applies the compressive force to the insert on the track, the roller means reducing the friction between the top insert and the hold-down member as the inserts are moved along the insert track and under the hold-down member as the inserts are moved towards the envelope insertion station.

8. The inserting device of claim 7 wherein the roller means comprises at least one shaft mounted roller, with the axis of the roller perpendicular to the direction of movement of the inserts along the insert track.

9. The inserting device of claim 7 wherein the roller means comprises at least two shaft-mounted rollers with an endless belt passing around the rollers, whereby the belt is free to rotate about the rollers in the direction of movement of the inserts along the insert track.

10. The inserting device of claim 9 wherein at least one of the rollers is connected to power drive means to cause the roller to rotate and drive the endless belt in the direction of movement of the inserts.

11. In an inserting device adapted to feed individual inserts from stacks thereof to a station wherein the inserts are inserted within envelopes, an improved insert transport means compromising:

an insert track on which the inserts are deposited after being withdrawn from the insert stack;

chain drive means with lugs mounted thereon on the insert track for moving the inserts in a forward direction along the insert track towards the insertion station;

an insert hold-down member which pivots out of the way of the inserts as the inserts are withdrawn and deposited onto the insert track and which pivots to a position above and on top of the inserts to apply a compressive force to the inserts after the inserts have been withdrawn and deposited on to the insert track;

belt means on the insert track to transport the inserts towards the insertion station and means to move the belt means towards the insertion station in co-operation with the movememt of the chain drive means, the belt means supporting at least a portion of the insert thereby reducing the friction between the insert and the insert track;

roller means mounted on a face of the insert hold-down member which contacts the top insert on the track when the hold-down member applies the compressive force to the insert on the track, the roller means reducing the friction between the top insert and the hold-down member as the inserts are moved along the insert track and under the hold-down member.

12. The inserting device of claim 11 wherein the belt means comprises an endless belt of which a portion rests on the insert track and the balance is below the insert track.

13. The inserting device of claim 11 wherein the means to move the belt means comprises at least two pulleys with the belt supported thereon, and drive means connected to at least one of the pulleys to rotate the pulley thereby moving the belt means.

14. The inserting device of claim 13 wherein the chain drive means has the chain supported by at least two sprocket gears and the drive means is connected to at least one of the sprocket gears to rotate the sprocket gear thereby moving the chain.

15. The inserting device of claim 14 wherein at least one of the sprocket gears and one of the pulleys are mounted on a common shaft, in front of the insertion station in the direction of insert movement, with the radius of the pulley smaller than the distance from the center of the sprocket gear to the top of the lug means so that the lug means alone continues to push the inserts towards and into the insertion station after the belt has dropped below the insert track due to its following the pulley circumference.

16. The inserting device of claim 15 wherein each sprocket gear and pulley comprise a set, with each set mounted on a common shaft to rotate together, and the lug means and belt move in unison.

17. The inserting device of claim 11 wherein the roller means comprises at least one shaft mounted roller, with the axis of the roller perpendicular to the direction of movement of the inserts along the insert track.

18. The inserting device of claim 11 wherein the roller means comprises at least two shaft mounted rollers with an endless belt passing around the rollers, whereby the belt is free to rotate about the rollers in the direction of movement of the inserts along the insert track.

19. The inserting device of claim 11 wherein at least one of the rollers is connected to power drive means to cause the roller to rotate and drive the endless belt in the direction of movement of the inserts.

* * * * *